US005221198A

United States Patent [19]

Izumi et al.

[11] Patent Number: 5,221,198

[45] Date of Patent: Jun. 22, 1993

[54] SCROLL TYPE COMPRESSOR WITH INTAKE PORT ALIGNED WITH COUNTERWEIGHT

[75] Inventors: Yuji Izumi; Tetsuhiko Fukanuma; Tetsuo Yoshida; Tatsushi Mori, all of Kariya, Japan

[73] Assignee: Kabushiki Kaisha Toyoda Jidoshokki Seisakusho, Kariya, Japan

[21] Appl. No.: 987,539

[22] Filed: Dec. 7, 1992

Related U.S. Application Data

[63] Continuation of Ser. No. 719,259, Jun. 21, 1991, abandoned.

[30] Foreign Application Priority Data

Jul. 18, 1990 [JP] Japan ..... 2-76435[U]

[51] Int. Cl.[5] ..... F04C 18/04; F04C 29/02

[52] U.S. Cl. ..... 418/55.3; 418/55.6; 418/100; 418/151

[58] Field of Search ..... 418/55.1, 55.3, 55.5, 418/55.6, 100, 151

[56] References Cited

U.S. PATENT DOCUMENTS

| | | | |
|---|---|---|---|
| 4,325,683 | 4/1982 | Miyazawa | 418/55.3 |
| 4,484,869 | 11/1984 | Nakayama et al. | 418/151 |
| 4,527,963 | 7/1985 | Terauchi | 418/100 |
| 4,538,975 | 9/1985 | Tsukagoshi | 418/55.6 |
| 4,547,137 | 10/1985 | Terauchi et al. | 418/55.2 |
| 4,934,909 | 6/1990 | Suzuki et al. | 418/55.6 |

FOREIGN PATENT DOCUMENTS

| | | | |
|---|---|---|---|
| 57-62988 | 4/1982 | Japan . | |
| 57-148087 | 9/1982 | Japan . | |
| 57-148092 | 9/1982 | Japan . | |
| 59-24992 | 2/1984 | Japan . | |
| 60-135684 | 7/1985 | Japan . | |
| 1-193091 | 8/1989 | Japan . | |
| 1-193092 | 8/1989 | Japan | 418/55.3 |

*Primary Examiner*—John J. Vrablik

*Attorney, Agent, or Firm*—Brooks Haidt Haffner & Delahunty

[57] ABSTRACT

A scroll type compressor comprising a stationary scroll member (2) and a movable scroll member (4) accommodated in a housing (10, 39), the scroll members (2, 4) being engaged with each other so that the movable scroll member (4) is subjected to an orbital motion around the stationary scroll member (2) and forms compression chambers (39) therebetween, in which chambers (39) a coolant gas is compressed by a volume reduction of the chamber (39) in accordance with the orbital motion, and is discharged therefrom to a refrigeration circuit. An intake port (8) for introducing the coolant gas into the housing (10, 30) is provided at a position closer to lubrication indispensable mechanisms such as a main bearing (32) or a sealing means (31) while confronting the periphery of a counterweight (35). The coolant gas is sucked into the interior of the housing (10, 39) and fed to the lubrication indispensable mechanisms (31, 32). When the counterweight (35) is positioned on the side closer to the intake port (8), the coolant gas is introduced directly therefrom to the compression chamber (39).

4 Claims, 5 Drawing Sheets

SCROLL TYPE COMPRESSOR WITH INTAKE PORT ALIGNED WITH COUNTERWEIGHT

This application is a continuation, of application Ser. No. 07/719,259, filed Jun. 21, 1991, abandoned.

BACKGROUND OF THE INVENTION (1) Field of the Invention

The present invention relates to a scroll type compressor suitable for an automobile air conditioner, more particularly, to an improvement thereof of the lubrication for a sealing means, bearings, and an anti-spin mechanism.

(2) Description of the Related Arts

A small size scroll type compressor suitably used for an automobile air conditioner is disclosed in Japanese Unexamined Patent Publication No. 57-62988. According to this scroll type compressor (hereinafter referred to as "compressor"), as shown in FIG. 5, a stationary scroll member 52 comprising a stationary side plate 521 and a stationary spiral body 522 is fixed to a housing half 51, and movable scroll member 54 comprising a movable side plate 541 and a movable spiral body 542 is arranged in the housing half 51 and other housing half 53. The movable scroll member 54 is engaged with the fixed scroll member 52, and thus a plurality of compression chambers 56 are formed therebetween.

Within the interior of a housing consisting of both housing halves 51 and 53, is rotatably secured a driving shaft 59 via a sealing means 57 and a main bearing 58, and a pin 60 is eccentrically mounted to the inner end of the driving shaft 59. To a base end region of the pin 60 closer to the main bearing 58 is fixed a counterweight 61, and to the other end region is fixed a drive bush 64 which supports the movable scroll member 54 by a bearing 63 so that, in association with an anti-spin mechanism, the movable scroll member is subjected only to an orbital motion and cannot spin on its own axis. Structures and functions of the counterweight and the anti-spin mechanism are described in detail such as in Japanese Unexamined Patent Publication Nos. 57-148,087 or 57-148,092.

As the spiral bodies 522 and 542 are defined by involute curves engageable with each other, volume variations occur in each compression chamber 56 formed between the scroll members 52 and 54 in accordance with the orbital motion of the movable scroll member 54, and this causes a coolant gas to flow into the compression chamber 56 through an intake port 55, which gas is successively compressed in the chamber 56 and flows out of an exit port 65 arranged centrally in the scroll members 52, 54, into a flow-out chamber 66, and finally, is fed to a refrigeration circuit (not shown) through a fluid discharge port 67.

In the compressor of the abovesaid type, the lubrication for front side mechanisms, such as the sealing means 57, the bearings 58, 63 or the anti-spin mechanism 62, is carried out by oil particles contained in the coolant gas.

According to the conventional compressor, however, the intake port 55 is provided in the housing wall closer to a rear side, i.e., to the compression chamber 56, rather than to the lubrication indispensable mechanisms in the front side area, so that the coolant gas can be directly taken into the compression chamber 56 while keeping the intake resistance at a lowest level. Accordingly, the coolant gas cannot be smoothly introduced to the lubrication indispensable mechanism, whereby it also becomes difficult to be sufficiently feed the lubricant in the coolant gas to such mechanisms, and in the worst case, a seizure or over-wear of these mechanisms may occur.

To avoid such problems, it has been proposed to provide an additional path in the housing for communicating the intake port and the sealing means (see Japanese Unexamined Utility Model publication No. 59-24992). According to this means, however, it is necessary to form, at an entrance of the additional path, a stepped portion having a complicated shape, to correctly guide a lubricant in the coolant gas into the additional path, which lowers the productivity thereof.

Thus, an object of the present invention is to provide a means for readily feeding a sufficient amount of lubricant to the mechanisms arranged in the front side region of the scroll type compressor, while avoiding an increase of the intake resistance of the coolant gas.

SUMMARY OF THE INVENTION

The above object is achieved by a scroll type compressor, according to the present invention, comprising a housing, a stationary scroll member fixed to the housing, a movable scroll member engaged with the stationary scroll member and forming compression chambers between the two scroll members, a drive shaft rotatably secured in the housing by a main bearing, a pin eccentrically mounted on the inner end region of the drive shaft, a drive bush secured on the pin and supporting the movable scroll member so that the movable scroll member is subjected to an orbital motion via a bearing while inhibited, by an association with an anti-spin mechanism, from a rotation about its own axis, and a counterweight mounted on the drive shaft for absorbing a dynamic unbalance of the movable scroll member, whereby a coolant gas is taken into the compression chamber through an intake port and pressurized in the compression chamber before being discharged therefrom, in accordance with the orbital motion of the movable scroll member, and is characterized in that the intake port is formed in a region of the housing wall where the extension of the rotational plane of the counterweight intersects with the housing wall, and communicates with an intake path directly connected to the compression chamber.

Preferably, the counterweight is shaped to positively guide the coolant gas toward the front side area. For example, the surface of the counterweight closer to the front side area may be tapered so that the counterweight has a thinner width from the center of rotation toward the periphery thereof.

According to the compressor of the present invention, the coolant gas is sucked into the interior of the housing through the intake port formed in the defined region of the housing wall, due to a negative pressure caused by the rotation of the counterweight. When the counterweight occupies a rotational angular position at which the periphery of the counterweight is away from the intake port, the coolant gas flows into the housing without the interference of the counterweight and penetrates the lubrication indispensable mechanisms in the front side area, such as the sealing means, the main bearing or the anti-spin mechanism, whereby the sufficient lubrication can be performed. Thereafter, the coolant gas is introduced into the compression chamber. On the other hand, when the counterweight occupies a rotational angular position at which the periphery of the counterweight confronts closer to the intake port, the main part of the coolant gas is guided to the intake path directly communicating with the compression chamber. Accordingly, the lubrication for the lubrication indispensable mechanisms is assuredly carried out once a rotation of the counterweight.

The use of the counterweight having a shape which enhances the guiding of coolant gas to the front side of the housing, enables the coolant gas to be better introduced to the lubrication indispensable mechanisms in accordance with the rotation of the counterweight.

BRIEF DESCRIPTION OF THE DRAWINGS

The present invention will be described in more detail with reference to the following drawings illustrating preferred embodiments thereof.

DESCRIPTION OF THE PREFERRED EMBODIMENTS

Figure 1:
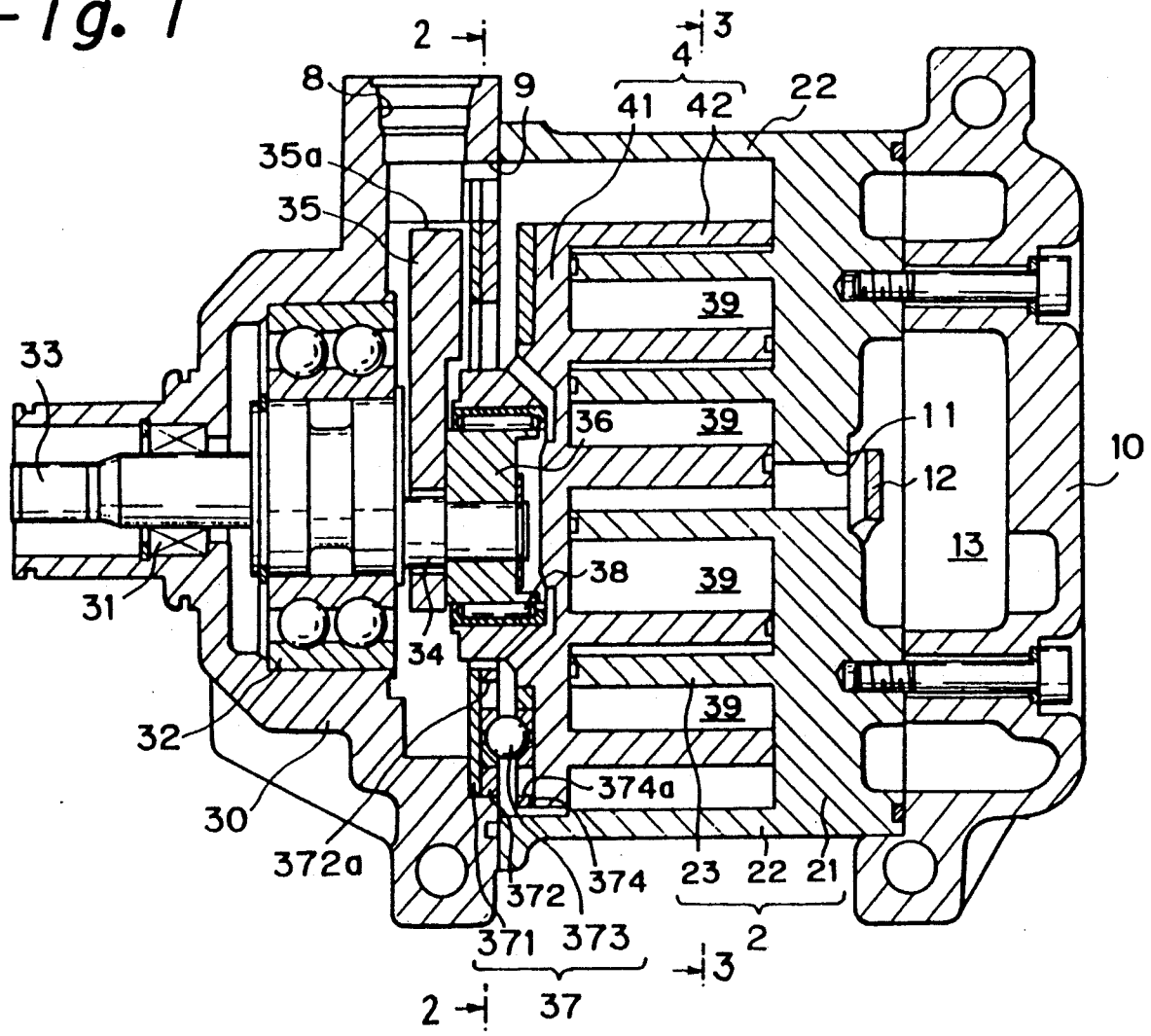
FIG. 1 is a side sectional view of a scroll type compressor according to a first embodiment of the present invention.

As shown in FIG. 1, a scroll type compressor of a first embodiment of the present invention has a stationary scroll member 2 consisting of a stationary side plate 21, an outer shell 22 formed integrally with the stationary side plate 21, and a stationary spiral body 23 formed in the inner side of the stationary side plate 21 and defined by an involute curve. The stationary scroll member 2 is associated with a movable scroll member 4 consisting of a movable side plate 41 and a movable spiral body 42 formed in the inner side of the stationary side plate 41, and is defined by another involute curve so that a plurality of compression chambers 39 are formed by the engagement of the spiral bodies 23, 42 with each other. Within the interior of a front housing 30 rigidly connected to the outer shell 22 of the stationary scroll member 2 through a fastening means, a drive shaft 33 is rotatably supported by a sealing means 31 and a main bearing 32. At the inner end of a larger diameter portion of the drive shaft 33 is eccentrically implanted a pin 34 to which a drive bush 36 is mounted. The bush 36 rotatably supports the movable scroll member 4 through a bearing 38 so that the movable scroll member can be subjected to an orbital motion while preventing a rotation thereof about its own axis, in association with an anti-spin mechanism 37. Further, a counterweight 35 is secured to the pin 34 or the drive bush 36 for absorbing a dynamic unbalance of the movable scroll member 4.

The anti-spin mechanism 37 consists of a stationary race 371 fixedly secured to the front housing 30, a stationary ring 372 fixedly mounted to the race 371 and having a plurality of positioning apertures **372*a* circularly arranged at a distance therebetween, a plurality of balls 373, each accommodated in the respective aperture 372*a*, and a movable ring 374 arranged opposite to the stationary ring 372 and having a plurality of positioning apertures 374*a* coinciding with the respective balls 373. The movable side plate 41 of the movable scroll member 4 is fixedly secured to the movable ring 374 of the anti-spin mechanism 37, and an exit port 11 is provided through the central portion of the stationary side plate 21 of the stationary scroll member 2 and communicated with the compression chamber 39 in the discharging phase. A rear housing 10 is fixedly secured to the stationary scroll member 2 to form a flow-out chamber 13 inside of the rear housing 10, and the flow-out chamber 13 is communicated with the compression chamber 39 through the exit port 11 via a check valve 12**, and with a refrigeration circuit through a fluid discharging port (not shown).

Figure 2:
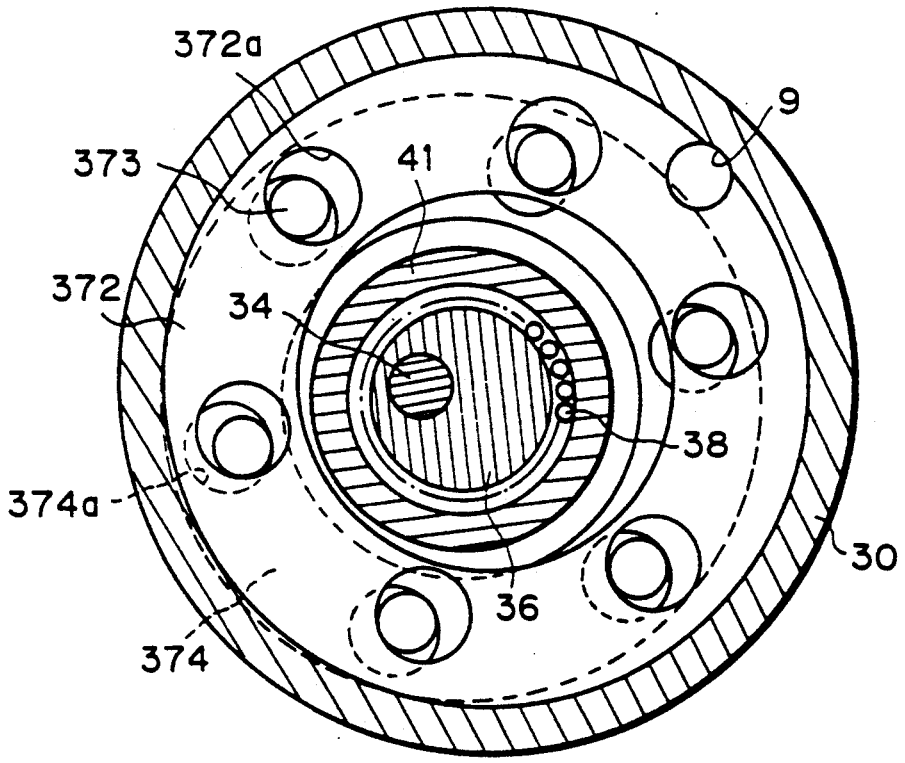
FIG. 2 is a section taken along line 2—2 in FIG. 1.
Figure 3:
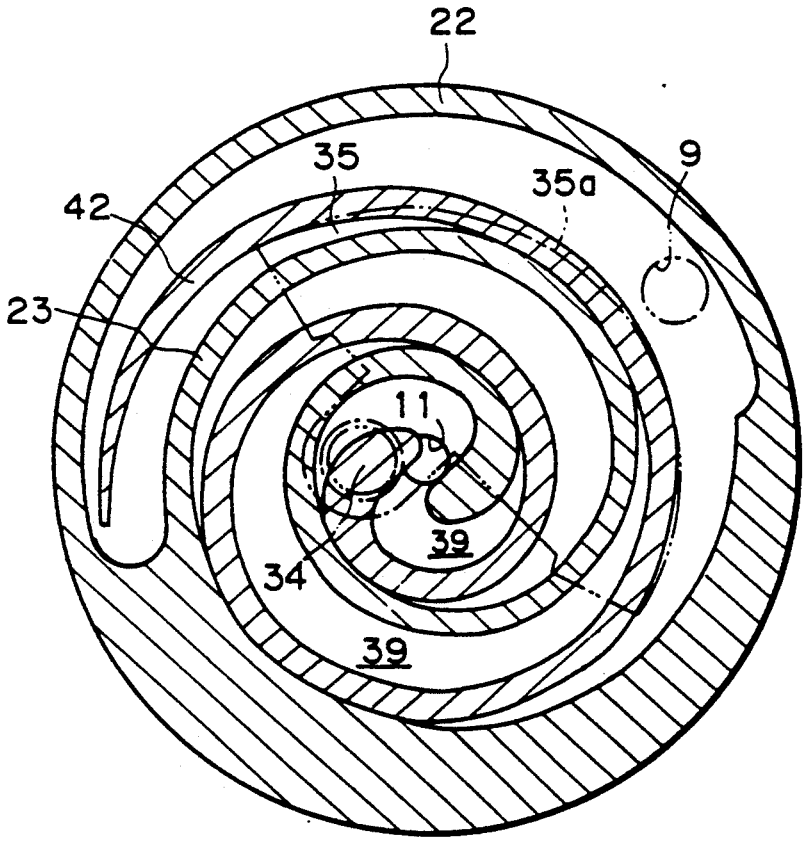
FIG. 3 is a section taken along line 3—3 in FIG. 1.

A characteristic feature of the present invention is the structure of an intake port 8 communicating with the refrigeration circuit. The intake port 8 is formed in the wall of the front housing 30 so that it is positioned in a region with which an extension of a rotational plane of the counterweight 35 intersects. That is, during the rotation of the counterweight, the periphery **35*a* of the counterweight can alternately occupy two positions, away from the intake port 8 and closer thereto. An intake path 9 is formed, as shown in FIGS. 1, 2 and 3, adjacent the inner surface of the housing or outer shell 22, between two neighboring balls 373, through the wall of the front housing 30, the stationary race 371 and the stationary ring 372 so that the intake port 8 is directly communicated with the interior of the compression chamber 39, whereby a coolant gas can flow into the compression chamber 39 without interference by the counterweight 35. Thus, an inlet to the compression chamber 39 is provided radially outward (beyond the maximum reach) from the periphery of the counterweight 35**. Therefore, free inlet access is afforded to the compression chamber.

The operation of the above compressor will be explained below:

The compressor is driven by power from an engine (not shown) transmitted to a drive shaft 33 (FIG. 1) via an electromagnetic clutch (not shown). The movable scroll member 4 is subjected to an orbital motion by the action of the driving bush 36 in association with the anti-spin mechanism 37. FIG. 3 illustrates the volume variation of the compression chambers 39, a shape of the counterweight 35, and a position of the intake path 9. Due to the rotation of the counterweight 35 having substantially a sector shape, a negative pressure is generated in the area behind the counterweight, when seen in the rotational direction. A coolant gas is readily introduced into the interior of the housing through the intake port 8 due to this negative pressure, and fed to the neighboring main bearing 32 and sealing means 31. After passing through the anti-spin mechanism 37 and bearing 38, the coolant gas flows into the compression chamber 39, the interior of which has a negative pressure due to the volume variation. In an angular phase of rotation of the counterweight 35 shown in FIG. 1, at which the periphery **35*a* confronts the intake port 8, the coolant gas is directly introduced into the compression chamber 39 through the intake path 9 communicating with the intake port 8. Therefore, the coolant gas can be smoothly sucked in the compression chamber 39 without interference. Thereafter, the coolant gas in the compression chamber 39 is successively pressurized due to the orbital motion of the movable scroll member and delivered from the compression chamber 39 into the flow-out chamber 13 through the exit port 11 against the check valve 12**, before being fed to the refrigeration circuit.

While, when the counterweight 35 further makes half a rotation from the position shown in FIG. 1, the periphery 35*a* no longer confronts the intake port 8. Thereby main part of the coolant gas sucked into the interior of the housing from the intake port 8 is directed to the intake path 9 and directly reaches the compression chamber 39 without resistance.

As stated above, according to the present invention, the coolant gas is sufficiently fed to the lubricant indispensable mechanisms once a rotation of the counterweight. The structure of the inventive compressor is relatively simple and can be easily and effectively manufactured. Also, as the intake resistance of the coolant gas is not increased compared to the conventional compressor, the engine is not subjected to an excessive burden.

Figure 4:
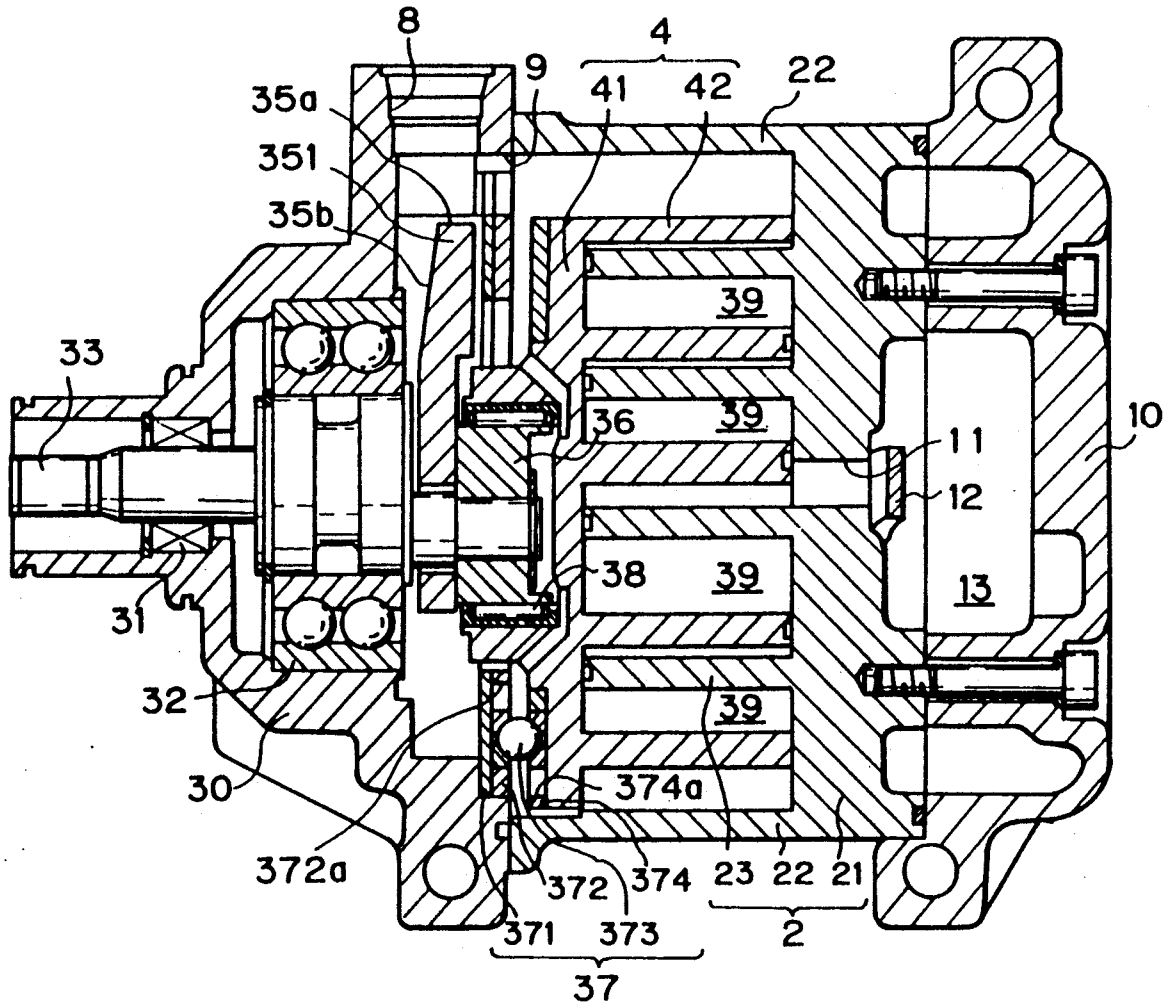
FIG. 4 is a side sectional view of a scroll type compressor according to a second embodiment of the present invention.
Figure 5:
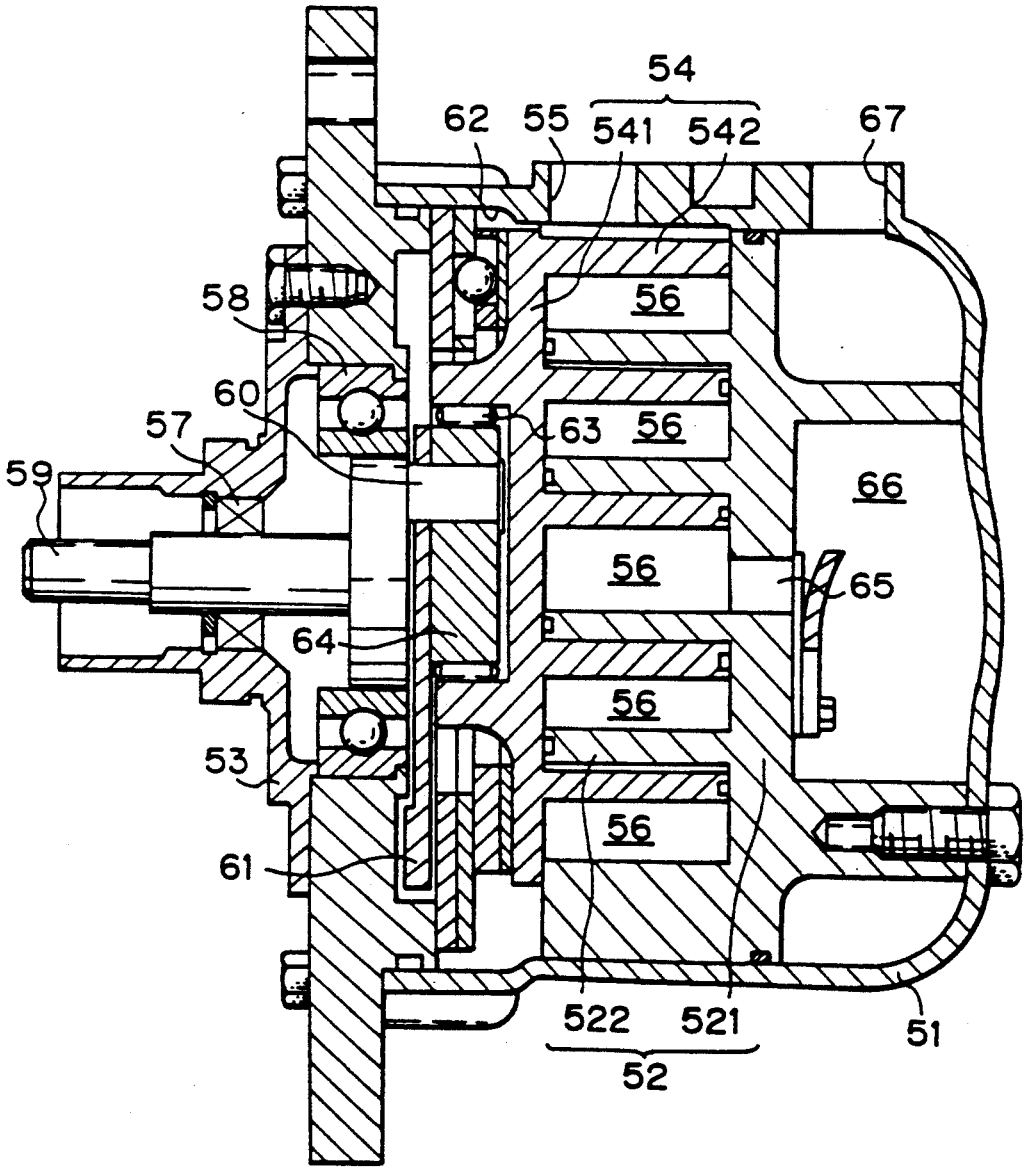
Fig. 5 PRIOR ART
FIG. 5 is a side sectional view of a scroll type compressor according to the prior art.

A second embodiment of the present invention will be explained below with reference to FIG. 4. The basic structure thereof is substantially the same as that of the first embodiment, and accordingly, the same reference numerals are used in FIG. 4 as used in FIGS. 1 through 3 to designate similar parts and clarify the relationship therebetween.

In the second embodiment, the shape of a counterweight 351 is different from that shown in FIG. 1, i.e., a thickness of the counterweight 351 becomes thinner as a function of a distance from the rotational center to the periphery of the counterweight, as defined by a slanted front side surface 35*b*. According to this structure, the guiding of the coolant gas toward the front side is further enhanced by the slanted surface 35*b* when the counterweight 351 is rotating, whereby a better lubrication of the front side mechanisms is achieved.

According to the embodiments stated above, the intake port is provided through the wall of the front housing, but this is not essential to the present invention, as the intake port may be formed in another position if the structure of the compressor permits, provided that it confronts the periphery of the counterweight. Also, the intake path need not be bored through the stationary race, if the structure of the compressor permits.

We claim:

1. A scroll type compressor comprising a housing, a stationary scroll member disposed within said housing, a movable scroll member cooperatively disposed relative to said stationary scroll member with a plurality of compression chambers formed therebetween, a drive shaft journalled for rotation in a bearing disposed in said housing with a first end external to and a second end within said housing, said movable scroll member being eccentrically mounted on said second end of said drive shaft for orbital motion about the axis of said shaft upon turning of said drive shaft, an anti-spin mechanism disposed between said housing and said movable scroll member for inhibiting rotation of said movable scroll member, said bearing being disposed along with sealing means therefor on the front side of said anti-spin mechanism between the latter and said housing, a counterweight mounted on said drive shaft between said anti-spin mechanism and said bearing for absorbing dynamic imbalance of said movable scroll member, an intake port disposed in said housing where the extension of the rotational plane of said counterweight intersects said housing on the front side of said anti-spin mechanism, and an intake path provided radially outwardly of the orbit of the periphery of said counterweight directly interconnecting said intake port with said compression chambers, said intake path between said intake port and said compression chambers being adjacent an inner surface of said housing.

2. A scroll type compressor as defined by claim 1, wherein said counterweight is sector shaped and spaced in the axial direction sufficiently from adjacent structure to positively deliver the coolant gas toward lubricant demanding mechanisms accommodated within the housing on either side of said counterweight.

3. A scroll type compressor as defined by claim 2, wherein the thickness of said counterweight diminishes toward the periphery thereof as a function of the distance from the rotational center of the counterweight.

4. A scroll type compressor as defined by claim 1, wherein said anti-spin mechanism comprises a plurality of circumferentially spaced balls, and said intake path is disposed between a selected two neighboring balls of said anti-spin mechanism.

* * * * *